United States Patent [19]

Tumlinson

[11] Patent Number: 4,555,987

[45] Date of Patent: Dec. 3, 1985

[54] METHOD AND APPARATUS FOR EXTRACTION OF ALOE VERA GEL

[76] Inventor: Larry N. Tumlinson, 826 W. 22nd St., Mission, Tex. 78572

[21] Appl. No.: 516,299

[22] Filed: Jul. 22, 1983

[51] Int. Cl.[4] ..... B30B 9/20; B30B 9/24

[52] U.S. Cl. ..... 100/118; 100/37; 100/130; 100/121; 99/495

[58] Field of Search ..... 100/118, 119, 120, 151, 100/152, 153, 154, 130–135; 99/495

[56] References Cited

U.S. PATENT DOCUMENTS

| | | | |
|---|---|---|---|
| 602,620 | 4/1898 | Flory | 100/118 |
| 1,360,882 | 11/1920 | Carlson | 100/130 X |
| 3,183,955 | 5/1965 | James | 99/495 |
| 3,797,127 | 3/1974 | Yamada et al. | 100/93 RP |
| 4,488,482 | 12/1984 | Cottrell | 100/37 |

*Primary Examiner*—Peter Feldman

*Attorney, Agent, or Firm*—Dodge, Bush & Moseley

[57] ABSTRACT

An apparatus for extraction of uncontaminated aloe vera gel from the leaves of aloe vera plants. The harvested leaves of the aloe vera plants are positioned between a pair of endless moving belts for passing by a plurality of crushing rollers arranged in a desired pattern. The rollers first crush the core of the leaf to enable the gel to flow internally while a second set of rollers extrudes the gel from the leaf. The crushed leaf and extruded gel is then deposited on a drain grate to enable gravity flow separation of the gel from the crushed leaves. The drainage grate is sloped in order that the leaves will slowly move across the drain grate to enable separation of the gel while removing the leaf from the gel collection area prior to the flowing of the contaminate aloin from the leaf.

7 Claims, 2 Drawing Figures

METHOD AND APPARATUS FOR EXTRACTION OF ALOE VERA GEL

BRIEF SUMMARY OF THE INVENTION

1. Technical Field

This invention relates broadly to the extraction of aloe vera gel from agricultural plant leaves and in particular to an apparatus for extracting high purity aloe vera gel in a commercial quantity.

2. Background Art

While the present invention relates broadly to the field of a method and apparatus for extracting a liquid component from agricultural products, the present invention is disclosed in the setting of an embodiment of a method and apparatus for obtaining a desired gel extract from the leaves of aloe vera plants.

Most agricultural products contain a single desirable juice or liquid to be extracted by extruding the ripened product. For example, citrus fruits such as oranges or grapefruit or other fruits, such as apples, are frequently processed by crushers that force or extrude the juice from the fruit for enabling subsequent separation of the solid or pulp material from the juices.

The following patents of which Applicant is presently aware relate to various methods and apparatus for extracting a desired liquid from agricultural products or for separating a liquid from a slurry:

| U.S. PAT. NO. | PATENTEE |
|---|---|
| 91,210 | C. L. Carter |
| 198,226 | Zacharias Thoman |
| 248,083 | O. F. Boomer |
| 348,019 | J. E. Jones |
| 1,659,733 | F. M. Barbeck |
| 3,126,819 | A. Wehner |
| 3,601,039 | Donald S. Schover |
| 3,613,564 | M. A. Wheeling, et al |
| 3,720,159 | Otto Gunkel |
| 3,851,685 | Ahrweiler, et al |

The Boomer U.S. Pat. No. 248,083 discloses a roller press having a plurality of gear driven rollers pressing on a pair of movable endless belts to continuously squeeze liquid from the material placed between the moving belts. Cider is one of a number of liquids listed as suitable for extraction from apples by this machine. The Carter U.S. Pat. No. 91,210 is entitled "Cider Mill" and discloses a pair of slatted endless moving belts that provide a converging pressing channel therebetween for crushing apples to extract and separate the juice.

Another embodiment "Cider Mill" is disclosed in Thoman U.S. Pat. No. 198,226. The apples are ground before an endless belt passes or carries them between a series of pairs of pressing rollers to extrude the juice. The "Cider Press" disclosed in Jones U.S. Pat. No. 348,019 also uses an endless carrying belt passing between pairs of pressing rollers.

U.S. Pat. No. 1,659,733 to Harbeck also discloses an endless apron operating "Cider Press" but is of much later vintage. To increase the capacity of the press spring created urging or pressing forces are used to produce the constant crushing of the fruit to extract the liquid.

The more recent patents noted above disclose rather sophisticated presses for various liquid extraction purposes. For example, press platens having an arrangement for reducing contact friction between the moving belt and the crushing force of the platens are disclosed in Ahrweiler et al. U.S. Pat. No. 3,851,685. A sequential operated juice press having a controlled arrangement for maintaining the crushing force on the fruit for a predetermined time to assure maximum juice extraction and unique separation or flow path through the endless filter cloth for the extracted liquid is disclosed in Gunkel U.S. Pat. No. 3,720,159. U.S. Pat. No. 3,613,564 to Adamski et al discloses a dewatering press for solid sludge formation as does Schover U.S. Pat. No. 3,601,039. A sludge dewatering press is also disclosed in Wehner U.S. Pat. No. 3,126,819.

U.S. Pat. No. 3,878,197 to Maret is entitled "Process For Preparing Extracts Of Aloe Vera" and sets forth many of the problems encountered in extracting the desired gel from the center of the leaves of the aloe vera plants. The aloe vera plant is more formally known as aloe barbadensis Miller and provides a large triangular shaped leaf having a thickness that may approach one inch (2.54 cm). The leaves of the aloe vera plant have a relatively dense outer layer, rind, or peel surrounding the relatively soft leaf core that is filled with aloe vera gel. Disposed between the gel containing core and the outer peel is a thin liquid layer of aloin which is released when the peel is cut or broken, such as during harvesting. The aloin is a highly undesirble yellowish colored liquid extract which is considered a contaminate for the aloe vera gel extract. Among the undesirable characteristics of aloin are a bitter taste and a cathartic action which render the aloe vera completely unacceptable for human consumption. The bright yellowish color of the aloin also colors any aloe vera containing product intended for external use that substantially reduces consumer acceptance. As noted in the Maret patent, crushing the entire aloe vera leaves, such as with the equipment or apparatus disclosed in the previously mentioned patents, results in a contamination of the gel with the yellowish aloin which produces a low grade extract of limited commercial use. At the present time, there is no available commercial process for separating the aloin from the gel to upgrade the contaminated gel. As a result, the contamination of the aloe vera gel renders the gel valueless.

Because of the contamination of the gel by the aloin, most gel extraction has been done by hand trimming or filleting each leaf to remove all traces of the layer of aloin. This has entailed cutting the peel away from the core of gel material and thereafter squeezing the fillet or core of the leaf in a conventional manner to extract the gel, as is disclosed in the Maret Patent. While this method produced the desirable uncontaminated gel, it was an extremely wasteful operation as a substantial portion of the gel containing core portion of each leaf was severed and discarded. In addition, the process of filleting each leaf was time consuming, expensive and somewhat hazardous due to the sharp cutting knives employed.

BRIEF SUMMARY OF THE INVENTION

The present invention relates to a method and apparatus for extracting high purity aloe vera gel from the leaves of the aloe vera plants.

The harvested leaves are cleansed or washed to remove any trace of the undesired aloin remaining on the outer rind from the severing of the leaves during the harvesting operation. The washed leaves are then passed through an extraction press having a pair of continuously moving belts positioned between crushing rollers arranged to selectively force the aloe vera gel from the core of the leaf and enable gravity flow separation of the gel from the leaf before the aloin in the leaf rind begins to extrude or flow. The crushed leaves are removed from the aloe vera gel recovery zone before the aloin can contaminate the extracted aloe vera gel. The resulting uncontaminated aloe vera gel is then collected and processed further as desired.

The continuously moving endless belts enable a high rate of operation as they greatly speed movement of each leaf between the crushing rollers as well as increasing gel recovery by assuring complete crushing of each leaf. The apparatus and method of use of the present invention provide a commercial operation for extracting the aloe vera gel without having to first remove the layer of aloin.

DETAILED DESCRIPTION OF THE PREFERRED EMBODIMENT

Figure 1:
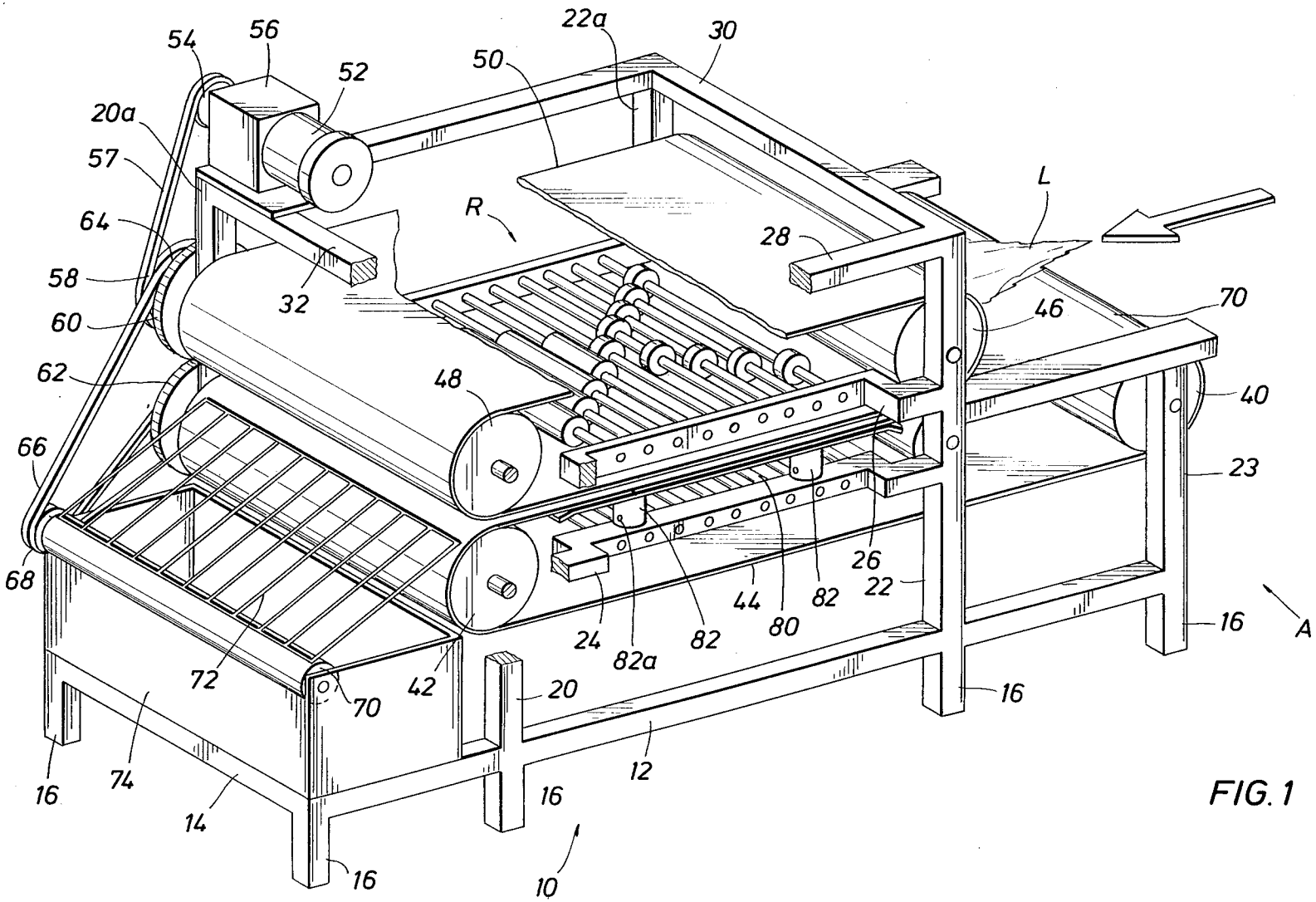
FIG. 1 is a perspective view of the aloe vera extraction apparatus of the present invention.

The apparatus, generally designated A, of the present invention is best illustrated in the perspective view of FIG. 1. The apparatus provides a commercial method for the extraction of aloe vera gel from harvested leaves of the aloe vera plant with a minimum of prior treatment. The triangular shaped aloe vera leaves are normally in the range of 7.0 to 10.0 centimeters wide at the base and usually have a length of longitudinal axis exceeding 50.0 centimeters. The leaves are shaped substantially in the form of equilateral triangles when harvested with the base of the triangle formed by the severed or cut end portion of the leaf to separate it from the trunk of the aloe vera plant.

The aloe vera leaves are formed of a relatively soft core filled with the desired aloe vera gel. The core is surrounded by a protective dense outer peel or rind. Disposed between the outer peel and the core is a layer of aloin, a yellowish contaminant of the aloe vera gel. The presence of the layer of aloin has in the past required that it be separated from the core prior to crushing the core to extrude the aloe vera gel. The apparatus A of the present invention provides a method for recovering the aloe vera gel without the need to remove the layer of aloin prior to crushing the aloe vera leaf for extracting the gel.

The apparatus A of the present invention includes a structural support frame, generally designated 10 formed with support members of sufficient strength and rigidity to maintain the apparatus A in operating condition or relationship. The particular arrangement of the members of the support frame is not critical to the present invention and are described for illustrative purposes only, since those skilled in the art may desire to modify the support frame for other purposes In the illustrated embodiment (FIG. 1), a rectangular base is formed by horizontally disposed members 12 and 14 having corresponding members (not illustrated) disposed in parallel relationship to form the rectangular base. The horizontal members 12 and 14 are supported by a suitable plurality of support legs 16 in the conventional manner.

A plurality of parallel upwardly extending or vertical support members 20, 22 and 23 extend upwardly from the side horizontal member 12. The vertical members 20 and 22 are connected at spaced intermediate locations by horizontal side structural support members 24, 26 and 28 as desired. Suitable horizontal cross members 30 and 32 may be employed to connect with vertical members **22*a* and 20*a*** with sufficient rigidity and strength. The back side of the apparatus A is arranged in a similar manner.

As noted hereinabove, the precise arrangement or location of the various members of the support frame 10 may be arranged in a different manner as desired as long as the resulting frame is of sufficient strength and rigidity to maintain the components of the apparatus A in operating relationship when processing the aloe vera leaves.

The apparatus A further includes a first or lower pair of belt drums 40 and 42 that are rotatably mounted with the support frame 10 in any desired conventional manner at spaced apart locations with the drums 40 and 42 extending substantially the width of the cross members 14. Disposed about the first pair of belt drums 40 and 42 is a first endless belt 44 formed of suitable impervious flexible material. Disposed above the first pair of belt drums 40 and 42 is a second or upper pair of belt drums 46 and 48 that are also rotatably mounted with the support frame 10 at spaced apart locations. (In the illustrated embodiment, the pairs of belt drums are spaced apart different distances, but it is understood that the pairs of belt drums may be spaced apart the same distances without departing from the present invention). A second endless belt 50 similar to the belt 44 is disposed about the second pair of belt drums 46 and 48 and in contact with the belt 44 to form a zone therebetween.

Mounted with the support frame 10 is a suitable power or drive means such as electric motor 52 having rotatable pulley 54 operably connected thereto such as by a suitable intermediate gear box 56. The gear box 56 may also be used as the mounting base for the electric motor 52 to the support frame 10.

While the illustrated manner of driving or rotating the belt drums 48 and 42 in opposite directions will be described, it will be understood that other arrangements for driving either one or both of each pair of belt drums are well known to those skilled in the art. In the illustrated embodiment, belt 57 mounted with pulley 54 rotates pulley 58 mounted with the belt drum 48 for effecting its rotation. Spur gear 60 mounted with the belt drum 48 engages spur gear 62 for rotating the belt drum 42 in the opposite direction in order that the belts 44 and 50 move in the same direction between the pairs of belt drums. A pulley 64 also mounted on belt drum 48 drives the belt 66 for turning the pulley 68 on roller wiper 70 for a purpose to be described in greater detail hereinafter. While the use of the spur gears 60 and 62 would indicate that there would be synchronized movement of the belt drums 42 and 48 and thereby no relative movement between the contacting portions of the first belt 44 and the second belt 50, it would also be understood that a slight variation or slippage in movement between the belts may be desired or may result from slippage. The desired rotation of the belt drums 48 and 42 is arranged that when the leaf L is positioned at the inlet end on the endless belt 44 the leaf will be fed between the endless belts 44 and 50 for movement through the apparatus A from adjacent the rollers 40 and 46 towards the driven rollers 42 and 48 where the leaf L will be discharged from the zone between the belts 44 and 50.

Angularly disposed adjacent the lower discharge belt drum 42 is a drainage platform or grate 72 which is pivotly mounted with the support frame 10 to ride only endless belt 44 to enable the leaves L to slide or transfer from the lower belt 44 onto the drainage grate 72. The drainage grate 72 enables the gravity flow of the extruded gel or liquid from the aloe vera leaf into a receiver or collecting vat 74 disposed below the collection grid. The rotating wiper 70 serves to prevent flow of the desired gel from the grate 72 and directs such flow back into the receiver 74, and is wiped clean by rubber wiper attached to receiver 74. Suitable piping, not illustrated, is provided to the receiver 74 for collecting the aloe vera gel for further processing as desired.

As will be explained in greater detail hereinafter, the grate 72 is tapered, angled or slanted to enable the crushed aloe vera leaves to slide across the grate 72 at a rate or speed which will enable the desired aloe vera gel to separate from the leaf and flow into the receiver 74. The crushed leaf will slide off of the grate to a collection bin (not illustrated) for discarding before the undesired aloin begins to flow from the leaf.

To crush the aloe vera leaves, a plurality of rollers is disposed between the first pair of belt drums 40 and 42 for supporting a crushing portion of the first or lower endless belt 44. The plurality of rollers is mounted by a plurality of air cylinders 82 having a first end 82*a* operably connected with the horizontal support member 24. By mounting the plurality of rollers 80 with the air cylinders 82 arranged to maintain the plurality of rollers urged upwardly towards the belt 44 a controlled crushing force is provided to the zone between the belts 44 and 50 while enabling sufficient limited movement of the plurality of rollers 80 and lower belt 44 to enable passage of thickened portions of the leaves L.

Figure 2:
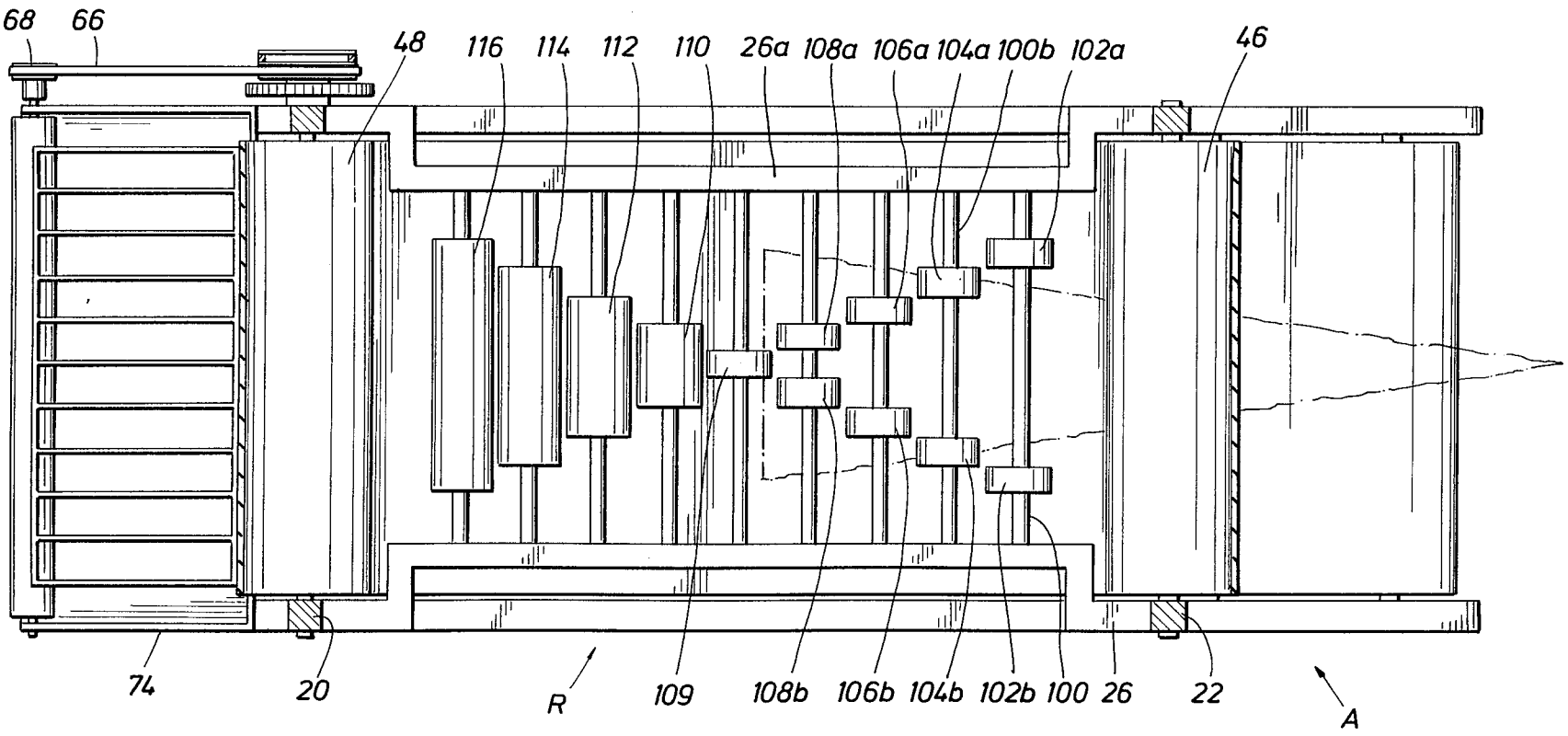
FIG. 2 is a top view illustrating a predetermined position of the rollers urging on the moving endless belts for extracting the aloe vera gel from the leaves.

For coacting with the lower plurality of rollers 80 for crushing the aloe vera leaves L, a plurality of rollers are arranged on the horizontal member 26 of the support frame 10 in the same predetermined crushing pattern. The plurality of rollers, generally designated R, are arranged in a two part pattern, best illustrated in FIG. 2 for crushing the aloe vera leaves positioned between the first and second endless belts in the zone between the plurality of rollers R and the plurality of rollers 80. The plurality of rollers R are journaled between horizontal support member 26 and companion side horizontal support member 26*a* of the support frame 10. As each of the plurality of rollers R is mounted with the support frame in a similar manner only one of the plurality of conventional roller mountings will be described in any detail. In particular, each of the plurality of rollers R has a mounting shaft 100 extending between the horizontal members 26 and 26*a* and which are mounted therewith by securing pins (not illustrated). The support shafts 100 are of sufficient rigidity to maintain the rollers R in position as the aloe vera leaves L move past the rollers Each of the shafts 100 has one or more plastic bushing or belt contacting rollers R rotatably mounted thereon for rolling contact with the upper belt 50 and urging the endless belts 44 and 50 into contact with the lower plurality of rollers 80. The rollers R are arranged in a predetermined pattern of two sets or steps for initially crushing the leaf to provide an internal rupturing of the core to enable the gel to flow from the leaf and a second set of rollers to extrude the gel from the leaf. The first set of rollers are essentially v-shaped (FIG. 2) so the initially engaged base of the leaf L (shown in phantom) is contacted adjacent the outer peel with the rollers 102 located on the initial shaft 100. The rollers 102*a* and 102*b* are spaced apart a sufficient distance for engaging the largest width leaf L and beginning the crushing of the core at the intersection of the rind and the outer portion of the harvesting cut or base of the triangle. The roller 104*a* and 104*b* mounted on the next shaft 100*b* are spaced closer together with a near or slightly overlapping relationship with the rollers 102*a* and 102*b* to continue to force the gel outwardly into the space vacated by rollers 102*a* and 102*b*. The next set of rollers 106*a* and 106*b* are positioned in a similar manner but slightly closer together. Likewise, 108*a* and 108*b* are positioned even closer together. The roller 109 is the sole roller located on that particular shaft and is centered in the machine. The resulting pattern formed by the first set of rollers provides a crushing action across the width of the leaf L for rupturing the core to form an outwardly flow passage to allow the escape of the gel from the core. Thereafter, the increasing width of rollers 110, 112, 114 and 116 are used to extrude or force the aloe vera gel from the core of the leaf. For some reason, either viscosity of the aloin fluid or the softness of the core of the plant relative to the rind, the gel commences to flow after crushing the leaf before the aloin.

Because of this feature when the leaf and extruded gel are then discharged between the belts 44 and 50 onto the grate 72 the gel is extruded, but not the aloin. The crushed leaves L slide across the grate 72 slowly in order that the aloe vera gel will separate from the leaf and flow by gravity into the receiver 74. Blade wipers (not illustrated) are used to scrape the gel from the lower belt 44 and upper belt 50 in a conventional manner. Likewise, the rotating scraper or roller 70 is used to catch the aloe vera gel flowing downwardly on the grate 72 for directing it into the receiver 74 to enhance or increase the recovery of the desired gel. The leaves L slide from the grate 72 into a discard container before the aloin commences to flow from the leaf in order that an uncontaminated gel, is collected within the receiver 74.

USE AND OPERATION OF THE PRESENT INVENTION

In the use and operation of the present invention, the apparatus A is assembled and operated in the manner previously described.

The aloe vera leaves L which have been harvested in the field by severing the base of the leaf from the plant are then washed or otherwise cleaned to remove any trace of aloin from the leaf resulting from the severing of the leaf during the harvesting operation. The cleansed leaf is then placed upon the endless belt 44 with the severed end toward Apparatus A and urged between the moving endless belts 44 and 50. The moving belts 44 and 50 grasp the leaf L in the condition illustrated. The endless belts 44 and 50 then move the leaf L between the plurality of rollers R and 80 which first crush the leaf L to enable the flow of the gel in the core of the leaf and then extrude the gel from the leaf with the second set of rollers. The leaves are then discharged from the belts 44 and 50 onto the discharge grid 72 where the gel is enabled to flow into the receiver 74. The leaves are discarded from the grid 72 prior to the aloin flowing from the leaf which would contaminate the gel within the receiver 74.

The foregoing disclosure and description of the invention are illustrative and explanatory thereof, and various changes in the size, shape and materials, as well as in the details of the illustrated construction may be made without departing from the spirit of the invention.

What is claimed is:

1. Apparatus for extraction of aloe vera gel from harvested leaves of the aloe vera plant, each of the aloe vera leaves having a relatively soft gel filled core surrounded by a dense outer peel covering with a layer of aloin disposed between the core and the rind, said apparatus including:

a support frame formed of sufficient strength and rigidity to maintain the apparatus in operating relationship;

a first pair of belt drums rotatably mounted with said support frame, said first pair of belt drums spaced apart a prearranged distance;

a first endless belt disposed about said first pair of belt drums;

means for rotating at least one of said first pair of belt drums for continuously moving said first endless conveyor belt;

a plurality of rollers for supporting a portion of said moving endless belt between said belt drums;

means mounted with said support frame for continuously urging said plurality of rollers for limited movement toward the supported portion of said endless belt;

an upper plurality of rollers arranged in a predetermined pattern opposite said lower plurality of rollers for crushing the aloe vera leaves against the portion of the first endless belt supported by the opposing plurality of rollers to extrude the aloe vera gel from the core of the leaves;

a drainage grate disposed adjacent one of the belt drums of said first pair of belt drums to enable the crushed aloe vera leaves to move from the endless belt to the drainage grate, said drainage grate arranged to support the crushed leaves thereon during the time while the aloe vera gel flows from the crushed leaves and to remove the crushed leaves from the drainage grate prior to the aloin extruding from the crushed leaf to prevent contamination of the aloe vera gel with the aloin; and a receiver disposed below said drainage grate for receiving and containing the gravity flow of aloe vera gel from the crushed leaves.

2. The apparatus as set forth in claim 1, including:

a second pair of belt drums rotatably mounted with said support frame, said second pair of belt drums spaced apart a desired distance;

a second endless belt disposed about said second pair of belt drums, said second endless belt having a portion adjacent said portion of said first endless belt supported by said plurality of rollers;

means for rotating at least one of said second pair of belt drums for continuously moving said second endless conveyor belt in a manner to move an aloe vera leaf positioned between said first endless belt and said second endless belt past said plurality of rollers and said plurality of rollers toward said drainage grate.

3. Apparatus for extraction of aloe vera gel from harvested leaves of the aloe vera plant, each of the aloe vera leaves having a relatively soft gel filled core surrounded by a dense outer peel covering with a layer of aloin disposed between the core and the rind, said apparatus including:

a support frame formed of sufficient strength and rigidity to maintain the apparatus in operating relationship;

a first pair of belt drums rotatably mounted with said support frame, said first pair of belt drums spaced apart a prearranged distance;

a first endless belt disposed about said first pair of belt drums;

means for rotating at least one of said first pair of belt drums for continuously moving said first endless conveyor belt;

a plurality of rollers for supporting a portion of said moving endless belt between said belt drums;

means mounted with said support frame for continuously urging said plurality of rollers for limited movement toward the supported portion of said endless belt;

an upper plurality of rollers arranged in a predetermined pattern opposite said lower plurality of rollers for crushing the aloe vera leaves against the portion of the first endless belt supported by the opposing plurality of rollers to extrude the aloe vera gel from the core of the leaves;

a drainage grate disposed adjacent one of the belt drums of said first pair of belt drums to enable the crushed aloe vera leaves to move from the endless belt to the drainage grate, said drainage grate arranged to support the crushed leaves thereon during the time while the aloe vera gel flows from the crushed leaves and to remove the crushed leaves from the drainage grate prior to the aloin extruding from the crushed leaf to prevent contamination of the aloe vera gel with the aloin;

a receiver disposed below said drainage grate for receiving and containing the gravity flow of aloe vera gel from the crushed leaves;

a second pair of belt drums rotatably mounted with said support frame, said second pair of belt drums spaced apart a desired distance;

a second endless belt disposed about said second pair of belt drums, said second endless belt having a portion adjacent said portion of said first endless belt supported by said plurality of rollers;

means for rotating at least one of said second pair of belt drums for continuously moving said second endless conveyor belt in a manner to move an aloe vera leaf positioned between said first endless belt and said second endless belt past said plurality of rollers and said plurality of rollers toward said drainage grate; and a plurality of air cylinders, each of said plurality of air cylinders having a first end operably mounted with said support frame, said plurality of air cylinders arranged to maintain said plurality of rollers urged toward said opposing plurality of rollers to provide sufficient crushing force therebetween while enabling sufficient limited movement to enable passage of the aloe vera leaves carried on said first endless belt.

4. The apparatus as set forth in claim 1, wherein, said drainage grate being sloped downwardly to enable the force of gravity to slide the crushed leaves across the drainage grate during the time that the aloe vera gel flows from the crushed leaves, said crushed leaves sliding off of said drainage grate prior to the aloin extruding from the crushed leaf.

5. The apparatus as set forth in claim 1, wherein said plurality of rollers includes:

a first set of rollers and a second set of rollers, said first set of rollers arranged to initially crush the core of the aloe vera leaf to form an exit flow path in the core for the gel, said second set of rollers to engage the leaf after the first set of rollers for extruding said gel from the core of the leaf.

6. The apparatus as set forth in claim 1, wherein said plurality of rollers includes:

a first set of rollers arranged to initially engage the outer edges of the severed end of the aloe vera leaf positioned on the first moving endless belt to crush the core of the leaf to form an exit flow path in the core for the the gel.

7. The apparatus as set forth in claim 5, wherein:

said first set of rollers arranged to contact the outer portions of the severed end of the leaf adjacent the rind and force the gel toward the edge of the leaf as the leaf moves past the first set of rollers.

* * * * *